US005327843A

United States Patent [19]

Gai

[11] Patent Number: 5,327,843

[45] Date of Patent: Jul. 12, 1994

[54] SAFETY DEVICE FOR HELM, THROTTLE AND DIRECTIONAL CONTROLS OF WATER VEHICLES

[75] Inventor: Giorgio Gai, Genoa, Italy

[73] Assignee: Ultraflex S.r.L., Genoa, Italy

[21] Appl. No.: 694,939

[22] Filed: May 2, 1991

[30] Foreign Application Priority Data

May 3, 1990 [IT] Italy ..... 12455 A/90

[51] Int. Cl.[5] ..... B63H 25/00

[52] U.S. Cl. ..... 114/144 R; 440/84; 440/87

[58] Field of Search ..... 114/144 R, 146, 144 A, 114/150, 128; 440/84, 87, 53, 55, 61, 62, 64

[56] References Cited

U.S. PATENT DOCUMENTS

| | | | |
|---|---|---|---|
| 3,169,505 | 2/1965 | Spraragen | 116/124 |
| 3,796,292 | 3/1974 | Harrison | 192/8 C |
| 4,106,426 | 8/1978 | Wertz | 114/144 R |
| 4,263,994 | 4/1981 | Hayes | 114/144 R |
| 4,495,881 | 1/1985 | Teraura | 114/144 R |
| 4,632,232 | 12/1986 | Kolb et al. | 192/96 |
| 4,710,141 | 12/1987 | Ferguson | 114/144 R |
| 5,105,924 | 4/1992 | Carlson | 192/8 R |

FOREIGN PATENT DOCUMENTS

| | | |
|---|---|---|
| 2709642 | 9/1978 | Fed. Rep. of Germany . |
| 2927070 | 2/1980 | Fed. Rep. of Germany . |
| 3432736 | 11/1985 | Fed. Rep. of Germany . |
| 3819346 | 12/1989 | Fed. Rep. of Germany . |

*Primary Examiner*—Joseph F. Peters, Jr.
*Assistant Examiner*—Stephen P. Avila
*Attorney, Agent, or Firm*—Birch, Stewart, Kolasch & Birch

[57] ABSTRACT

In a helm, throttle and directional control system for small craft, a safety device arranged to operate between an actuating member and an actuated member has such members coupled rotatively together by means of mechanical one-way coupling means wherein a resilient force holds the actuated member constantly biased to a locked position, and wherein the locking action is released by moving the actuating member against the resilient force, whereby motion can be transferred to the actuated member from the actuating member.

28 Claims, 4 Drawing Sheets

SAFETY DEVICE FOR HELM, THROTTLE AND DIRECTIONAL CONTROLS OF WATER VEHICLES

BACKGROUND OF THE INVENTION

1. Field of the Invention

This invention relates to helm, throttle and directional controls for small craft such as outboard, inboard, and inboard/outboard powered boats and similar water vehicles. More specifically, the present invention concerns a safety device which fits between an actuating member and an actuated member in helm, throttle and directional controls.

The actuating member may be a control drive shaft connected to the steering wheel of a boat, and the actuated member may be a driven shaft coupled to a control cable for the boat's steering device.

The actuating member may also be a control drive shaft connected to a throttle control lever and/or a reverse control lever for the boat's powerplant, and the actuated member may be a driven shaft coupled to a throttle control cable and/or a reverse gear control cable.

2. Description of Related Art

In connection with helm controls, it is a basic requirement that undesired and unintentional changes in the setting of the steering device should be prevented, especially for safety reasons. In fact, should the helmsman fall accidentally overboard, the water flow around the steering device is liable to act such that the steering device left to itself swings into an ever tighter turn, thereby the boat will circle around the man in the water on a closing spiral course and become a positive hazard.

Powerplant controls also require that no undesired change be applied fortuitously to any pre-selected settings.

A most widely employed method of preventing undesired and fortuitous changes to the setting of the actuated member has been that of braking the rotational movement of the actuating member as by means of a slip clutch between the actuating and actuated members. However, this tends to make the actuating member stiffer and tiring to operate, and in any event cannot provide failsafe unalterability of the setting where, for example, the forces acting on the actuated member are large ones.

SUMMARY OF THE INVENTION

Therefore, it is the object of this invention to provide a safety device for small craft helm throttle and directional controls which can fulfill the above-specified demands.

This object is achieved by a safety device for small craft helm, throttle and directional controls, intended for operation between an actuating member and an actuated member of the helm, throttle and directional controls, characterized in that the actuating and actuated members are coupled rotatively together through a one-way mechanical coupling means wherein a resilient force holds the actuated member constantly in a locked position, and release is accomplished automatically by moving the actuating member against said resilient force to transfer motion to the actuated member from the actuating member.

BRIEF DESCRIPTION OF THE DRAWINGS

For a clearer understanding of the features and advantages of this invention, some embodiments thereof will be described hereinafter with reference to the accompanying drawings, wherein.

DETAILED DESCRIPTION OF PREFERRED EMBODIMENTS

The safety device of this invention will be first described as applied to a steering wheel type of helm for a water vehicle with reference to FIGS. 1 to 8 of the drawings.

Figure 1:
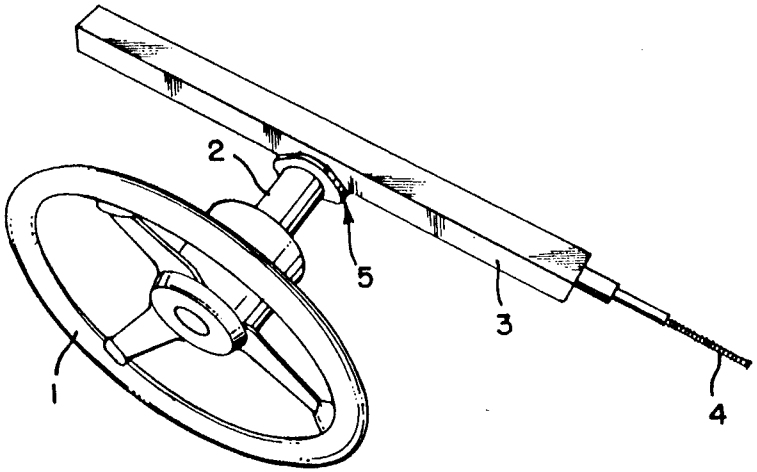
FIG. 1 is a perspective view of a steering wheel and associated helm box for the control cable in the steering system of a water vehicle.

With specific reference to FIG. 1, shown at 1 is the steering wheel of the helm of a water vehicle, e.g. a motor boat. The steering wheel drive shaft 2 penetrates a box 3 accommodating a unit whereby the helm control cable 4 can be operated. Of course, this cable control unit may be any suitable type to convert the rotary movement of the steering wheel 1 into a linear movement of the cable 4, and may either be of the rack-and-pinion, or chain-and-sprocket, or other comparable types. The safety device of this invention is interposed between the shaft 2 and the input end of the cable 4 control unit.

A first embodiment of the safety device according to the invention will be now described with reference to FIGS. 2, 3 and 4.

Shown at 5 in these drawing figures is a stationary pin, which may be affixed to the bottom of the box 3, for example. Tightly wound around this pin 5 is a cylindrical coil spring 6 having its ends 106 and 206 bent to project radially outwards, from diametrically opposite positions of the spring, as shown best in FIG. 4. That end of the shaft 2 which extends into the box 3 is shaped as a half-cup 7, so as to embrace the pin 5 and the spring 6 wound thereon with some radial and axial clearance, and extends circumferentially around the pin 5 through an angle of 2alpha, as shown best in FIG. 4. The radius for the half-cup shape 7 should be such that the latter engages, as the shaft 2 is rotated, with ends 106 and 206, respectively, of the spring 6, for purposes to be explained.

The half-cup shape 7 is also formed, at the base thereof where it does not interfere with the ends 106, 206 of the spring 6, with two teeth or dogs 107, 207 which extend circumferentially and symmetrically from either side through an angle alpha, whereby the half-cup shape will extend through 180° at the location of the teeth.

Reference numeral 8 is the driven shaft for operating the steering arrangement. In the embodiment shown, this shaft 8 is a tubular shaft mounted for free rotation on the shaft 2 concentrically therewith. The shaft 8 is terminated with a half-cup shape 9 having the same radius as the shape 7 and extending around the pin 5 through an angle of 180° -2alpha. Keyed on the other end of shaft 8 is a pinion gear 10 which may either mesh directly with the cable 4 in helical form as shown in FIG. 3, or with a rack connected to the cable 4.

Shaft 2 forms the actuating member for the helm system shown and shaft 8 its actuated member.

The device just described operates as follows.

Figure 2:
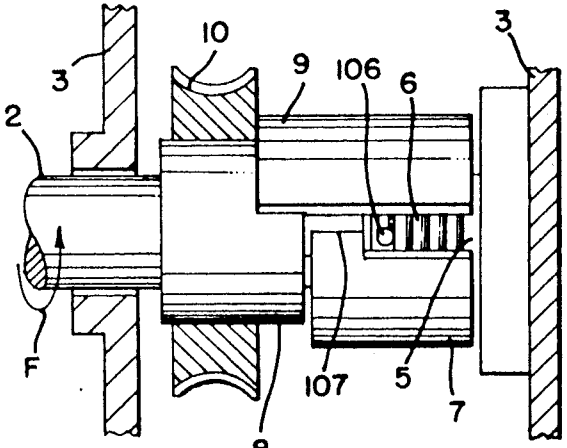
FIG. 2 shows a first embodiment of the safety device according to the invention.
Figure 4:
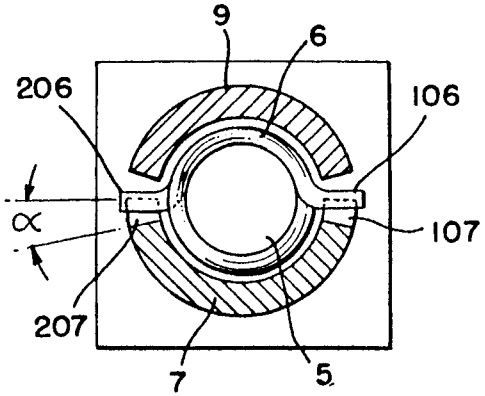
FIG. 4 is a cross-sectional view taken along the line IV—IV in FIG. 3.

Making reference in particular to FIGS. 1, 2 and 4, it will be assumed that the steering wheel 1 is turned in the counterclockwise direction, for example, as indicated by an arrow F in FIG. 2.

The half-cup shape 7 will be turned accordingly in that direction through the shaft 2 of the wheel 1. During a first fractional rotation, through the angle alpha in FIG. 4, shape 7 will abut against the end 106 of the spring 6 and urge it in the opposite direction from the winding direction of the spring 6 around the pin 5. This results in the winding of spring 6 being expanded, with consequent attenuation or removal of the frictional engagement between the spring 6 and the pin 5, whereby the spring 6 can be entrained to rotate with the shaft 2 of the steering wheel 1.

Concurrently therewith, the tooth 107 on the shape 7 will have come to bear on the shape 9 unitary with shaft 8, so that shaft 8 is also entrained rotatively by the steering wheel shaft 2, to therefore rotate the pinion gear 10 operating the helm control cable 4.

A similar effect would occur as the steering wheel 1 is turned clockwise. Shape 7 engages here the opposite end 206 of the spring 6, and the tooth 207 on shape 7 comes to bear on shape 9. Upon releasing the steering wheel, the spring 6 will resume its original condition of close adhesion to the pin 5. At this stage, a tensile force applied to the cable 4 from the steering device of the water vehicle will cause one edge of shape 9 to strike one end, 106 or 206, of the spring 6 along the winding direction of the spring around the pin 5, whereby the spring 6 will be locked onto the pin 5 by the strong frictional resistance and stop the movement of shape 9, so that the steering device cannot swing out of the setting imparted immediately prior to releasing the steering wheel. It should be emphasized that the action of shape 9 on the spring 6 tends to enhance the frictional engagement with the pin 5.

Figure 3:
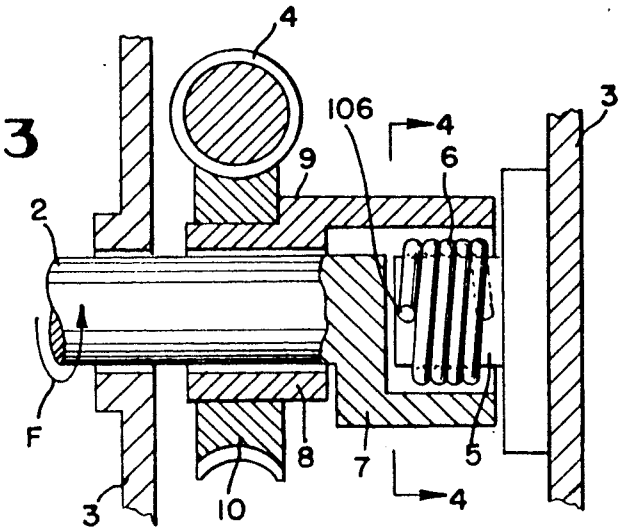
FIG. 3 is a view of the safety device in FIG. 2 with parts shown in longitudinal section.
Figure 6:
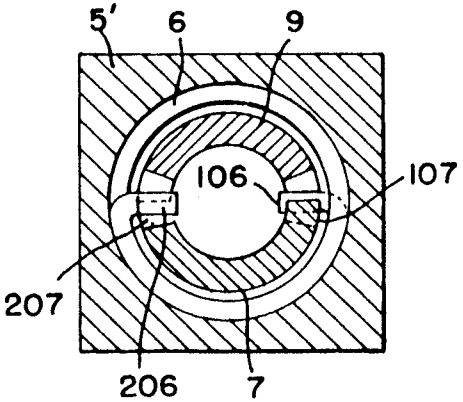
FIG. 6 is a cross-sectional view taken along the line VI—VI in FIG. 5.
Figure 5:
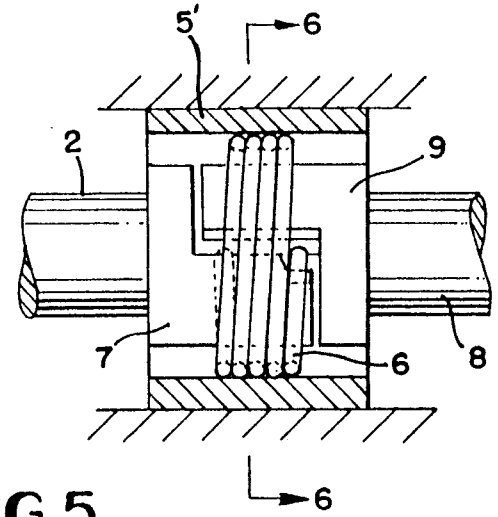
FIG. 5 shows a modified embodiment of the safety device according to the invention with parts shown in longitudinal section.

FIGS. 5 and 6 show a device quite similar to that in FIGS. 2, 3 and 4, and similar or corresponding parts of this device will be referenced, therefore, as in the previously described embodiment.

With reference to the drawing figures, the spring 6 is disposed with radial clearance around the two half-cup shapes 7 and 9, respectively unitary with the drive shaft 2 and the driven shaft 8, and is urged against a concentrical bush 5' affixed to the helm box 3 in any suitable manner.

The ends 106, 206 of the spring 6 are bent radially inwards so as to intervene between the half-cup shapes 7 and 9.

The operation of the safety device is here quite the equivalent for all the rest of that of the safety device embodied as in FIGS. 2, 3 and 4, it being understood that in this case the spring 6 will interact by frictional engagement with the bush 5'.

Figure 7:
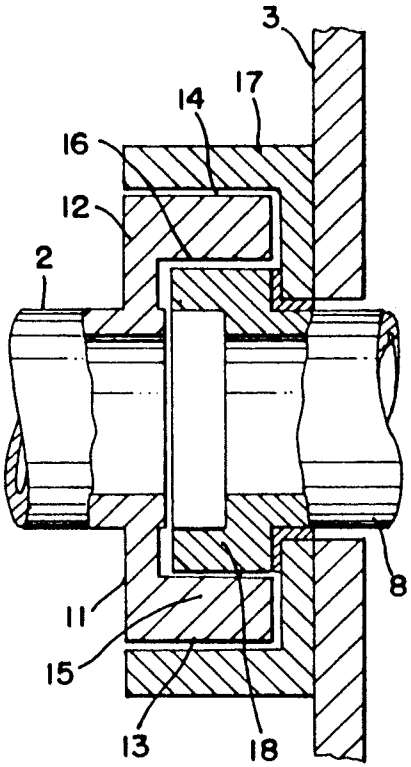
FIG. 7 is a longitudinal section view of a further embodiment of the inventive safety device.
Figure 8:
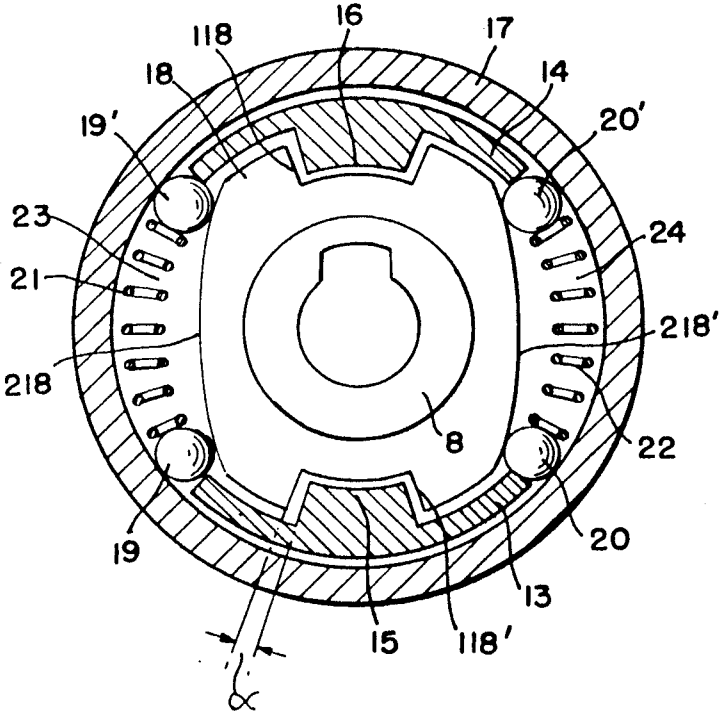
FIG. 8 is a cross-sectional view through the safety device shown in FIG. 7.

FIGS. 7 and 8 show a further embodiment of the safety device according to the invention.

With reference to these drawing figures, indicated at 2 is the drive shaft. This shaft is terminated with two radial arms 11 and 12 projecting from radially opposite positions. Connected to those arms 11 and 12 are two cylinder segment elements 13 and 14 which extend over an arc of about 90° and are each provided with a tooth or dog 15 and 16, respectively, centrally thereon, the teeth or dogs extending radially toward the center. The two segments 13 and 14 are accommodated inside a cylindrical case 17 attached to the box 3 in a freely rotatable manner with a small radial clearance. Located within the case 17, between the segments 13 and 14, is an element 18 connected to the driven shaft 8.

This element 18 is formed, at diametrically opposite locations thereon, with two notches 118, 118' engaging the teeth 15 and 16 with a backlash 2alpha. It also has, at diametrically opposite locations orthogonal to the notches 118, 118', two substantially straight surfaces 218, 218'. Two spaces 23 and 24, bound by the surfaces 218, 218', the inner wall of the cylindrical case 17, and the ends of the cylinder segments 13 and 14, accommodate two ball pairs 19, 19' and 20, 20' which are constantly biased in opposite directions toward the ends of the segments 13 and 14 by two springs 21 and 22. The diameters of the balls 19, 19' and 20, 20' are sized such that, in their rest position, the balls will wedge between the ends of the camming surfaces 218, 218' and the inner wall of the case 17.

The device just described operates as follows.

With the parts in the positions illustrated by FIG. 8, any attempt at rotating the driven shaft 8 in either direction would be defeated by the balls 19, 19' and 20, 20' wedging themselves between the surfaces 218, 218' and the inner wall of the case 17. A rotation of the drive shaft 2 will drive the elements 13 and 14 through a fraction of their stroke equivalent to the backlash angle alpha, whereby the ends of the elements are caused to act on two diametrically opposed balls, e.g. balls 19' and 20 when the shaft 2 is turned counterclockwise, and pry them out of the angle between the wall of the case 17 and the corresponding surface 218, 218' of element 18, thus enabling the shaft 2 to transfer rotary motion to the element 18 through the teeth 15 and 16, and thence to the driven shaft 8. On relieving the shaft 2 of the force applied, the device will be restored automatically to its locked condition by the action from the springs 21 and 22.

It is understood that the invention is not limited to the embodiments described and illustrated. As an example, the balls 19, 19' and 20, 20' could be replaced with some other rolling members, such as rollers.

Figure 10:
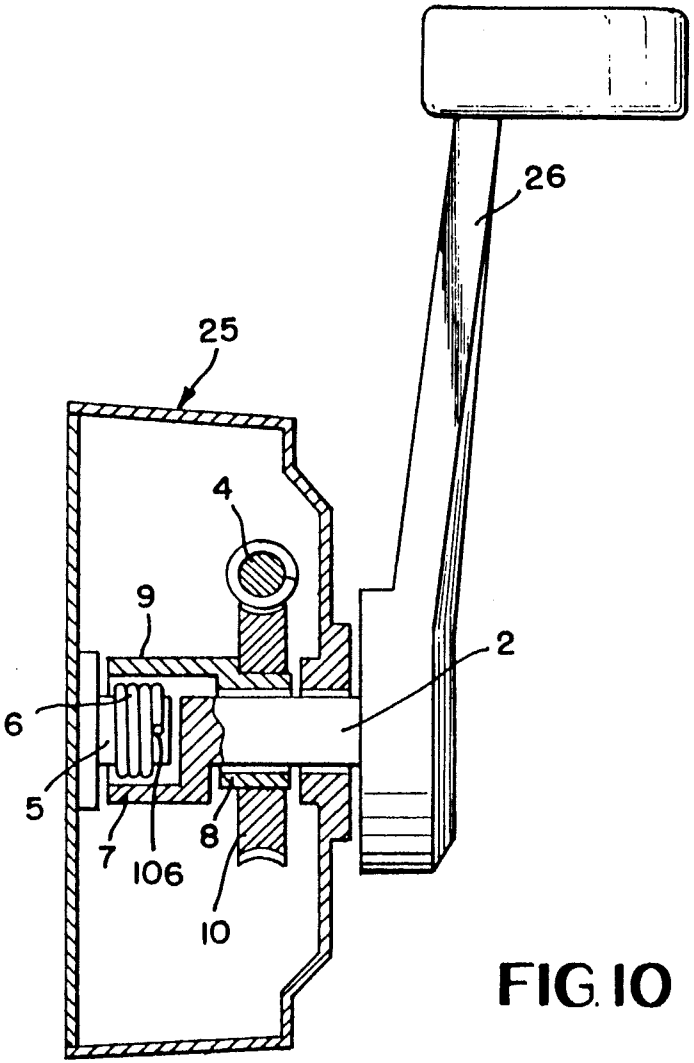
FIG. 10 is a cross-sectional view through the control box shown in FIG. 9, as equipped with the safety device of this invention.
Figure 9:
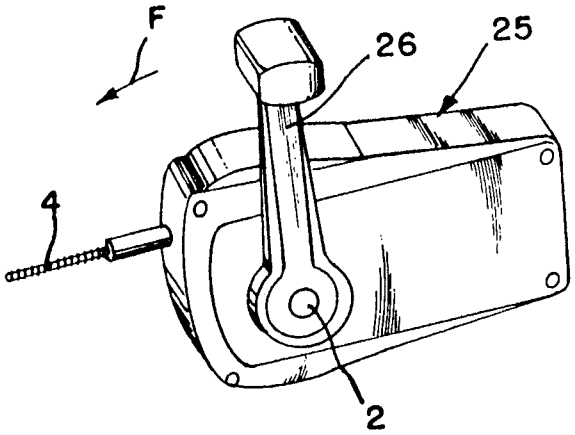
FIG. 9 is a perspective view of a dual-action, single lever control box providing control of the speed and reverse gear of a water vehicle powerplant and incorporating the safety device of this invention.

With reference to FIGS. 9 and 10, the safety device of this invention will be discussed hereinbelow as applied to a throttle control and reverse gear control for a water vehicle.

Shown in FIG. 9 is a remote control box 25 of the single lever 26 type as commonly employed to control the speed and direction of boats powered with outboard motors, or inboard engines, or inboard/outboard units equipped with hydraulically operated reverse gears.

As best shown in FIG. 10, the control lever 26 is keyed to one end of the actuating shaft 2 relating to the safety device shown in FIGS. 2, 3 and 4. The safety device could be obviously embodied alternatively as shown in FIGS. 5 to 8.

The operation of the device shown is self-evident. By moving the lever 26 in the direction of the arrow F in FIG. 9, for example, shape 7 is rotated in a counterclockwise direction through the shaft 2. During a first fractional rotation corresponding to angle alpha in FIG. 4, shape 7 is brought to bear onto the end 106 of spring 6, and repel this spring end in the opposite direction from the winding direction of the spring 6 around the pin 5. This results in the turns of the spring 6 being expanded and the frictional engagement of the spring 6 and the shaft 5 being consequently released, whereby the spring 6 is allowed to rotate together with the shaft 2 of the lever 26. Concurrently therewith, the tooth 107 on shape 7 comes to bear on the shape 9 unitary with shaft 8, whereby the shaft 8 will be also driven rotatively by the shaft 2 of the lever 26, resulting in rotation of the pinion gear 10 which operates the cable 4 wherethrough the engine throttle control can be adjusted.

A similar effect occurs when the lever 26 is moved in the opposite direction, in which case shape 7 will engage the other end 206 of the spring 6 and the tooth 207 on shape 7 will abut against shape 9. On releasing the control lever 26, the spring 6 will return to its original condition of close adhesion to the pin 5, thus locking the control system securely on the selected setting therefor and preventing all possibilities of the control system from being operated unintentionally and accidentally.

More generally, the actuating member and actuated member may be any elements at an upstream or downstream location, respectively, in the path of movement of a water vehicle helm and throttle/direction controls.

Figure 11:
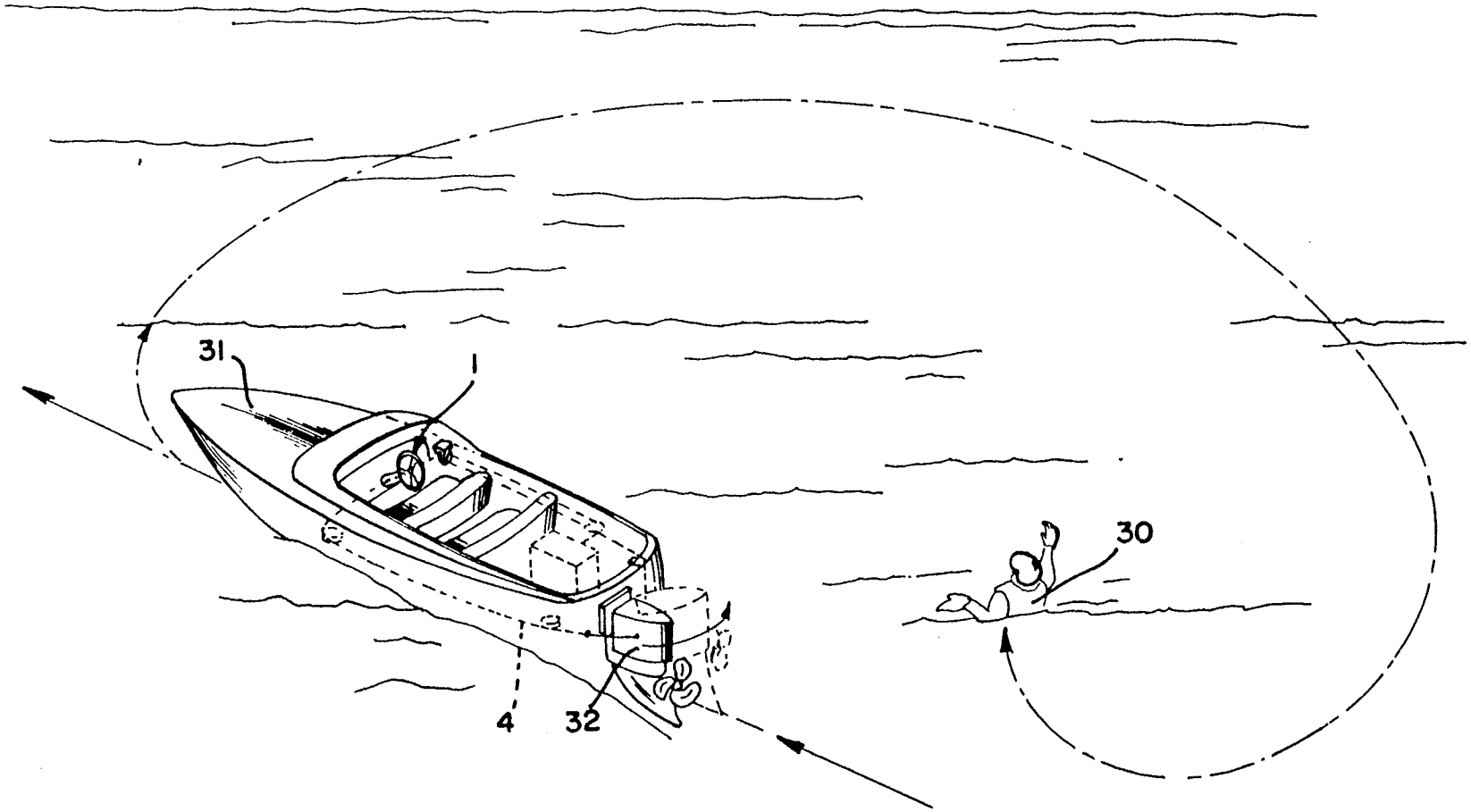
FIG. 11 depicts an applicative situation of the safety device according to the invention.

Depicted in FIG. 11 is a situation where a helmsman, shown at 30, has fallen overboard from a water vehicle, shown at 31, having its helm or steering system equipped with a safety device according to the invention. As shown in full lines, the water vehicle 31, presently with no one at the helm, will keep running in the same (straight, in the example) direction of its course before the helmsman fell overboard, since the steering device 32 of the water vehicle is locked by the inventive safety device in the same position as before the incident. Absent the safety device of this invention, the water flow around the steering device 32 would gradually bring the steering device to a position of tightest turn of the boat, thereby the boat would close in toward the man in the water along a spiral course and endanger his safety.

I claim:

1. A safety device for small craft helm, throttle and directional controls, intended for operation between a rotatable control drive shaft and a rotatable driven shaft of the helm, throttle and directional controls comprising:

a one way mechanical coupling for rotatively coupling the drive shaft and the driven shaft together, said one-way mechanical coupling including a first engaging element rigidly connected to the drive shaft and a second engaging element rigidly connected to the driven shaft, the first and second engaging elements being coaxially mounted and substantially geometrically matched with respect to each other for transmitting motion in a direction of rotation from said drive shaft to said driven shaft;

locking means, interposed and held by resilient force between said first and second engaging elements for preventing rotation from the driven shaft to the drive shaft, said locking means locking the second engaging element connected to the driven shaft and being unlocked by moving the first engaging element connected to the drive shaft against the resilient force;

a coil spring frictionally engaged with a stationary portion of the device;

means associated with said driven shaft and in abutment with ends of said spring for resisting rotation of said drive shaft;

first means associated with said drive shaft and adapted to cooperate with the ends of said spring for at least decreasing the frictional engagement of said spring with said stationary portion; and second means associated with said drive shaft for rotatively entraining said driven shaft after said first means has released said driven shaft from a locked position.

2. The safety device according to claim 1, wherein said spring is a cylindrical coil spring mounted to said element associated with a stationary portion of the device such that the action from said means associated with the driven shaft on ends of said coil spring enhances the frictional engagement with the element secured on said stationary portion, whereas the action from said first means associated with the drive shaft on the ends of said coil spring results in said engagement becoming attenuated or released altogether.

3. The safety device according to claim 1, wherein said second and first means associated with said driven and drive shafts, respectively, comprise half-cup shapes of equal radius which are coaxial with said shafts and extend circumferentially each through a smaller angle than 180°.

4. The safety device according to claim 3, wherein said second means associated with the drive shaft comprises teeth which extend circumferentially on either side of the half-cup shape associated with the drive shaft at locations free of interference with said ends of said springs, the angle formed by said teeth being 180°.

5. The safety device according to claim 1, wherein said drive shaft is connected to a steering wheel of the small craft and said driven shaft is coupled to a control cable of the small craft helm.

6. The safety device according to claim 1, wherein said drive shaft is connected to a throttle and/or reverse gear control lever for a powerplant of the small craft, and said driven shaft is coupled to a throttle and/or reverse gear control cable.

7. The safety device according to claim 1, wherein said coil spring is contracted by tightly winding it around an element consisting of a pin affixed to a stationary portion of the device, with ends of said coil spring being bent radially outwards for abutment against said first means associated with said drive shaft.

8. The safety device according to claim 1, wherein said drive shaft is connected to a throttle and/or reverse gear control lever for a powerplant of the small craft, and said driven shaft is coupled to a throttle and/or reverse gear control cable.

9. A safety device for small craft helm, throttle and directional controls, intended for operation between a rotatable control drive shaft and a rotatable driven shaft of the helm, throttle and directional controls comprising:

a one way mechanical coupling for rotatively coupling the drive shaft and the driven shaft together, said one-way mechanical coupling including a first engaging element rigidly connected to the drive shaft and a second engaging element rigidly connected to the driven shaft, the first and second engaging elements being coaxially mounted and substantially geometrically matched with respect to each other for transmitting motion in a direction of rotation from said drive shaft to said driven shaft;

locking means, interposed and held by resilient force between said first and second engaging elements for preventing rotation from the driven shaft to the drive shaft, said locking means locking the second engaging element connected to the driven shaft and being unlocked by moving the first engaging element connected to the drive shaft against the resilient force, wherein said locking means includes an outer casing member for housing said first and second engaging elements, two pairs of locking members continually biased in opposite directions and against said first engaging element, the locking members being removably wedged between an inner peripheral surface of said outer casing member and an external surface of said second engaging element unless acted upon by said first engaging element in a direction against the continually biased direction, and wherein said second engaging element includes diametrically opposed elongated arcuate sides and notched end portions positioned orthogonal to the elongated sides.

10. The safety device according to claim 9, further including two cylinder segments carried on said drive shaft and projecting inside a housing member, the outside diameter of said cylinder segments being substantially equal to the inside diameter of said housing member, a profile element disposed within said housing member between said cylinder segments and being keyed to the driven shaft, said profile element engaging said cylinder segments on two opposite sides with an amount of backlash, and wherein the opposite ends of said cylinder segments, wall of said housing member, and two opposite free sides of said profile element define two chambers therebetween, each accommodating two rolling elements constantly biased in opposite directions by a spring means thereby to abut against the ends of said cylinder segments by wedging in between the walls of said housing member and the cooperating sides of said profile element.

11. The safety device according to claim 10, wherein said cylinder segments extend through an arc of about 90°.

12. The safety device according to claim 10, wherein said profile element and said cylinder segments are mutually engaged by means of a dog clutch having an amount of backlash.

13. The safety device according to claim 10, wherein said rolling elements include balls.

14. The safety device according to claim 10, wherein said rolling elements include rollers.

15. The safety device according to claim 10, wherein said spring means include cylindrical compression coil springs.

16. The safety device according to claim 9, wherein said first engaging element includes a pair of diametrically opposed radial arms and means for engaging the notched end portions of said second engaging element.

17. The safety device according to claim 16, wherein outer surfaces of the elongated arcuate sides and an opposing inner peripheral surface of said outer casing defines a pair of elongated openings whereby the locking members abut against outer ends of said radial arms and are wedged at narrowest portions of the elongated openings.

18. The safety device according to claim 9, wherein said two pairs of locking members include two pairs of balls biased by two corresponding coiled springs.

19. The safety device according to claim 16, wherein said means for engaging includes a tooth/dog centrally positioned on each of the radial arms for mating with corresponding notches of said second engaging element.

20. The safety device according to claim 19, wherein the mating of the tooth/dog with a respective notch allows a clearance therebetween.

21. The safety device according to claim 16, wherein each of said radial arms extends over an arc of about 90° of said outer casing member.

22. A safety device for small craft helm, throttle and directional controls, intended for operation between a rotatable control drive shaft and a rotatable driven shaft of the helm, throttle and directional controls comprising:

a one way mechanical coupling for rotatively coupling the drive shaft and the driven shaft together, said one-way mechanical coupling including a first engaging element rigidly connected to the drive shaft and a second engaging element rigidly connected to the driven shaft, the first and second engaging elements being coaxially mounted and substantially geometrically matched with respect to each other for transmitting motion in a direction of rotation from said drive shaft to said driven shaft;

locking means, interposed and held by resilient force between said first and second engaging elements for preventing rotation from the driven shaft to the drive shaft, said locking means locking the second engaging element connected to the driven shaft and being unlocked by moving the first engaging element connected to the drive shaft against the resilient force;

a coil spring frictionally engaged with a stationary portion of the device;

means associated with said driven shaft and in abutment with ends of said spring for resisting rotation of said drive shaft;

first means associated with said drive shaft and adapted to cooperate with the ends of said spring for at least decreasing the frictional engagement of said spring with said stationary portion; and second means associated with said drive shaft for rotatively entraining said driven shaft after said first means has released said driven shaft from a locked position, wherein said coil spring is compressed into clutching engagement with inner walls of an element consisting of a surrounding bush secured on a stationary portion of the device, the ends of said spring being bent radially inwards to abut against said means associated with the driven shaft and be engaged by said first means associated with the drive shaft.

23. The safety device according to claim 22, wherein said spring is a cylindrical coil spring mounted to said element associated with a stationary portion of the device such that the action from said means associated with the driven shaft on ends of said coil spring enhances the frictional engagement with the element secured on said stationary portion, whereas the action from said first means associated with the drive shaft on the ends of said coil spring results in said engagement becoming attenuated or released altogether.

24. The safety device according to claim 22, wherein said second and first means associated with said driven and drive shafts respectively, comprise half-cup shapes of equal radius which are coaxial with said shafts and extend circumferentially each through a smaller angle than 180°.

25. The safety device according to claim 24, wherein said second means associated with the drive shaft comprises teeth which extend circumferentially on either side of the half-cup shape associated with the drive shaft at locations free of interference with said ends of said springs, the angle formed by said teeth being 180°.

26. The safety device according to claim 22, wherein said drive shaft is connected to a steering wheel of the small craft and said driven shaft is coupled to a control cable of the small craft helm.

27. The safety device according to claim 22, wherein said drive shaft is connected to a throttle and/or reverse gear control lever for a powerplant of the small craft, and said driven shaft is coupled to a throttle and/or reverse gear control cable.

28. The safety device according to claim 22, wherein said drive shaft is connected to a steering wheel of the small craft and said driven shaft is coupled to a control cable of the small craft helm.

* * * * *